US006560408B2

(12) United States Patent
Glucksman et al.

(10) Patent No.: US 6,560,408 B2
(45) Date of Patent: May 6, 2003

(54) HUMIDIFIER

(75) Inventors: Dov Z. Glucksman, Wenham, MA (US); Gary P. McGonagle, Lynn, MA (US); Laura P. Nickerson, Andover, MA (US)

(73) Assignee: Appliance Development Corporation, Danvers, MA (US)

( * ) Notice: Subject to any disclaimer, the term of this patent is extended or adjusted under 35 U.S.C. 154(b) by 0 days.

(21) Appl. No.: 09/838,880

(22) Filed: Apr. 20, 2001

(65) Prior Publication Data

US 2002/0154903 A1 Oct. 24, 2002

(51) Int. Cl.[7] ..... F17C 7/04
(52) U.S. Cl. ..... 392/403
(58) Field of Search ..... 392/386, 390, 392/394, 401, 402, 403, 405, 406, 324, 331, 333, 336, 337

(56) References Cited

U.S. PATENT DOCUMENTS

| | | | | | |
|---|---|---|---|---|---|
| 3,518,409 | A | * | 6/1970 | Corbett | 128/203.17 |
| 3,983,361 | A | | 9/1976 | Wild et al. | 219/433 |
| 4,019,298 | A | * | 4/1977 | Johnson, IV | 403/175 |
| 4,155,001 | A | | 5/1979 | Schossow | 219/287 |
| 4,201,737 | A | | 5/1980 | Carden | 261/142 |
| 4,463,248 | A | * | 7/1984 | Katzman et al. | 128/203.17 |
| 4,810,854 | A | | 3/1989 | Jursich | 219/276 |
| 4,818,344 | A | | 4/1989 | Glucksman | 202/176 |
| RE33,414 | E | | 10/1990 | Morton | 392/386 |
| 5,111,529 | A | | 5/1992 | Glucksman | 392/405 |
| 5,247,604 | A | | 9/1993 | Chiu | 392/406 |
| 5,309,930 | A | * | 5/1994 | Presser | 132/227 |
| 5,343,551 | A | | 8/1994 | Glucksman | 392/405 |
| 5,355,591 | A | * | 10/1994 | Caruso | 34/60 |
| 5,404,803 | A | * | 4/1995 | Glucksman | 99/473 |
| 5,611,967 | A | | 3/1997 | Jane et al. | 261/142 |
| 5,688,446 | A | | 11/1997 | Glenn | 261/142 |
| 5,835,680 | A | | 11/1998 | Glucksman et al. | 392/501 |
| 5,859,952 | A | | 1/1999 | Levine et al. | 392/405 |
| 5,970,211 | A | * | 10/1999 | Ritsher et al. | 392/337 |
| 6,085,459 | A | * | 7/2000 | Conner | 47/41.01 |
| 6,226,451 | B1 | * | 5/2001 | Wong | 261/142 |

* cited by examiner

*Primary Examiner*—Sang Paik
(74) *Attorney, Agent, or Firm*—George A. Herbster

(57) ABSTRACT

A humidifier comprises a water tank with a top opening and an assembly with a warm mist distributor and a vaporization module with a boiling chamber. The vaporization module has an insulated wall chamber, nozzles extending from a closed end proximate the warm mist distributor and an end closure at the opposite end. The end closure has a central opening the facilities filling and draining of the boiling chamber. In use the central opening is closed, and a labyrinth passage through the end closure meters the water that enters the boiling chamber.

34 Claims, 7 Drawing Sheets

HUMIDIFIER

CROSS-REFERENCE TO RELATED APPLICATIONS

U.S. application Ser. No. 09/571,231 filed May 16, 2000 by Dov Z. Glucksman for a Vapor Generator and assigned to the same assignee of this invention.

BACKGROUND OF THE INVENTION

1. Field of the Invention

This invention generally relates to humidifiers and more specifically to humidifiers that boil water as a part of a humidification by vaporization process.

2. Description of Related Art

The most common known means for humidifying rooms is a vaporizer that includes a water tank and an immersed spaced electrode assembly. With water in the water tank, voltage is applied to the spaced electrodes. If the water has electrolytic properties, a current passes between the electrodes and generates heat bringing to a boil water proximate the electrodes. Boiling vaporizes the water into steam that rises to the surface of the water and by normal thermal convection through an output port to outside air.

Such humidifiers generally are inefficient particularly as the vaporization rate decreases over time. Vaporization rate is a function of the conductivity of the water and the water level in the water tank. In some cases it becomes necessary to add an electrolyte, such as salt or baking soda, to promote conductivity to achieve adequate quantities of steam. As the water level in a water tank decreases, the effective heating area between the electrodes decreases reducing the vaporization rate. The boiling process acts as a distilling process and leaves deposits on the electrodes that also reduce the vaporization rate.

At the output from such a humidifier the steam is at an elevated temperature near the 100° C. boiling point temperature. Steam at this temperature can present a hazard if it contacts an individual. Over time the boiling process produces water circulation and elevates the temperature of all the water in the tank and the temperature of the water tank itself. Further, the assembly typically is held in place by gravity. If the humidifier is accidentally tipped, there is nothing to prevent all the heated water from spilling. It also becomes easy for someone to remove the cover with its electrodes during use thereby to pose a risk of electric shock if the electrodes are touched.

In order to overcome some of these disadvantages, a number of suggestions have been made for alternate designs. For example, it has been suggested to combine an immersible, self-contained heater with a fan for ejecting steam generated by the heating element with an air mixture. U.S. Pat. No. 3,809,374 (1974) to Schossow discloses one such humidifier having a small insulated vaporization chamber located centrally in a water tank or storage chamber with an electrically operated heater that heats water within the vaporization chamber. A fan above the chamber draws air and steam from the vaporization chamber and then expels it through an output port.

U.S. Pat. No. 4,155,001 (1979) to Schossow discloses another humidifier using an electrode type steam generator structure. A tubular member defines a boiling chamber and a pair of concentric electrodes define an area for boiling water.

U.S. Pat. No. 5,611,967 (1997) to Jane et al. discloses humidifier that has an evaporative cavity and a warm mist vaporization cavity. A selectively operable heating element is disposed within the warm mist cavity to vaporize liquid in that cavity. The resulting liquid vapor is discharged from a warm mist chamber into a surrounding element. In a combination evaporative/warm mist mode a fan induces further motion.

Each of these references discloses a system that overcomes some but not all the disadvantages of the original electrode-type humidifiers. The Schossow-374 patent provides an independent heater that is not dependent upon the electrolytic characteristics of the water, but requires the addition of a fan in order to effectively produce a warm mist. The Schossow-001 patent also requires a fan and utilizes the characteristic of water conductivity in order to achieve evaporation or boiling. The Jane patent discloses a vaporization system in which steam rises through a nozzle or vapor discharge tube to mix with air to the exterior of the vaporizer.

Other modifications to vaporizers have also been proposed that do not rely on a fan. For example, U.S. Pat. No. 5,247,604 (1993) to Chiu discloses a humidifier with a base that includes a liquid reservoir and a humidification mechanism that dispenses liquid contained in the reservoir. The reservoir includes a boiler cavity and a liquid supply channel between the boiler cavity and a supply tank. Water passes to the boiler cavity to be vaporized with the resulting steam rising through a nozzle that includes an open top and a well for receiving a medicant. As steam rises through the channel it heats any material in the medicant well. Steam then mixes with air after it leaves the channel.

In U.S. Pat. No. 5,343,551 (1994) to Glucksman an immersible heater boils water in a boiling or evaporation chamber. Steam generated during the boiling operation passes through a single nozzle and is directed into a vertical channel. As the steam accelerates passing through the nozzle, it produces an area of low pressure upstream of the tube. The tube is disposed in a chamber with opening to receive exterior air. Consequently combined air and steam pass through the tube and are exhausted exteriorly of the housing.

Each of these patents discloses particular features that represent improvements over original electrode-type vaporizers. However, each still has certain disadvantages. For example, the Glucksman patent discloses internal mixing of air and steam through a single nozzle. However, the resulting distribution of the mixture of air and steam is not even. Whereas the Chiu patent discloses a method of warming a medicant in order to promote dispersal of the medicant, no such structure is shown in the Glucksman patent. Notwithstanding these particular proposals, there still remains a significant bias toward using the conventional vaporizer with the spaced electrodes.

SUMMARY

Therefore it is an object of this invention to provide a humidifier that supplies a mixture of air and water vapor in a warm mist.

Therefore it is an object of this invention to provide a humidifier that supplies warm mist with an even distribution of water vapor and air in the warm mist.

Yet another object of this invention is to provide a humidifier that produces a warm mist and an entrained medicant.

Still yet another object of this invention is to provide a humidifier that maintains a substantially constant vaporization rate.

Yet still another object of this invention is to provide a humidifier that includes an internal boiling chamber that allows water in a surrounding tank to remain at essentially room temperature.

In accordance with this invention, a humidifier includes an open top water tank for storing water. The water tank supports a warm mist distributor with a mixing chamber proximate the open top. A vaporization module in the water tank depends from the warm mist distributor. The vaporization module includes a boiling chamber with a heater. A plurality of nozzles direct steam from the boiling chamber to the mixing chamber thereby to produce a warm mist output.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
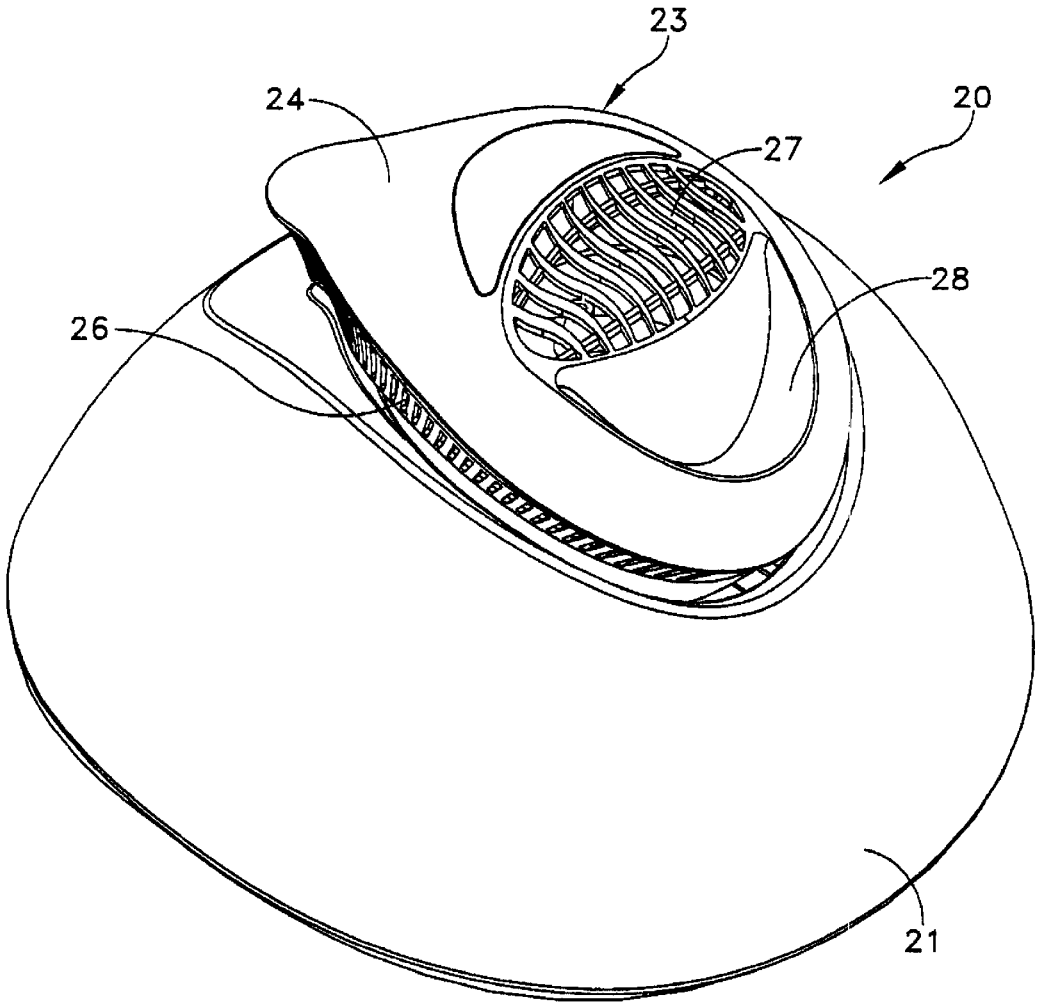
FIG. 1 is a perspective view of a humidifier constructed in accordance with this invention.
Figure 2:
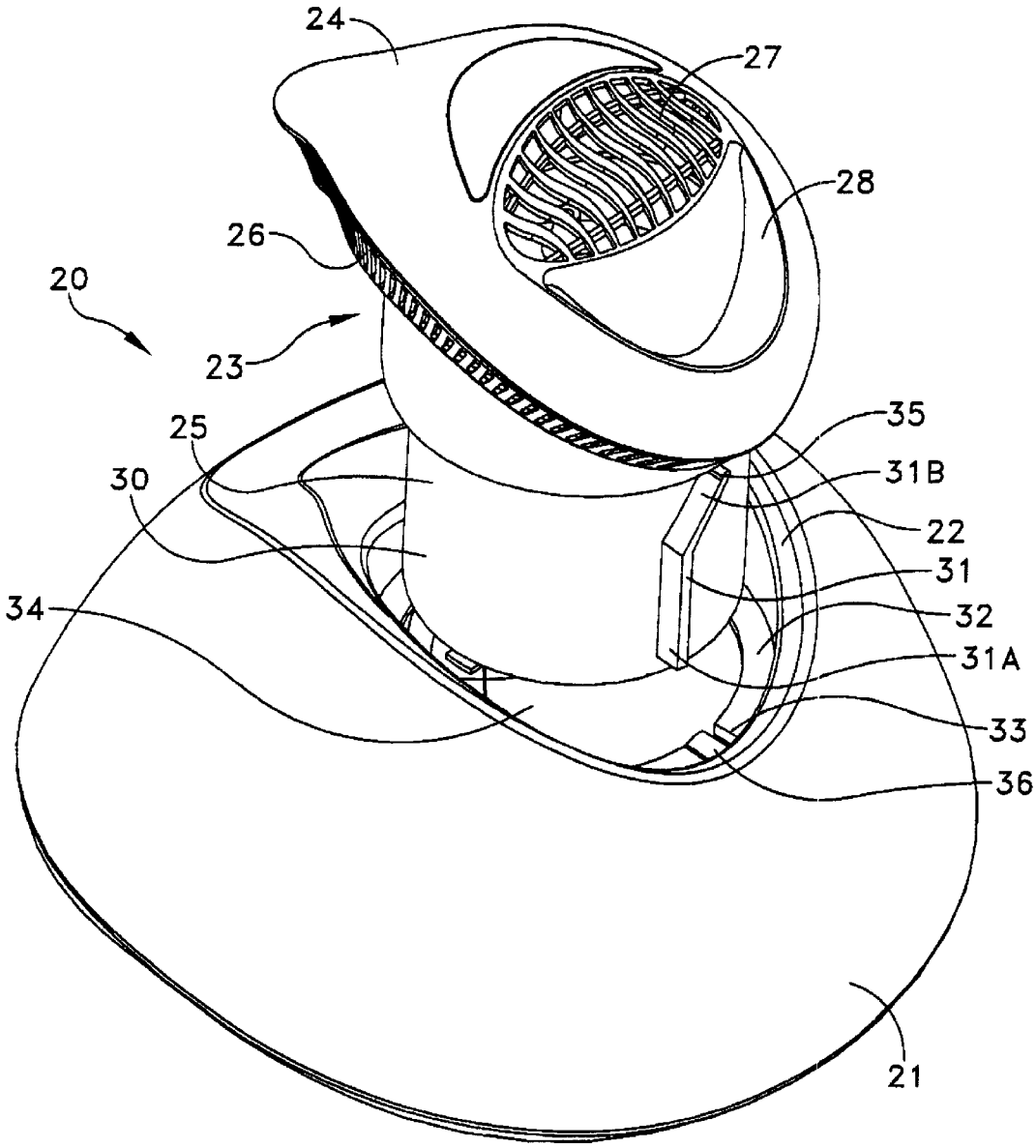
FIG. 2 is an exploded perspective view of the humidifier shown in FIG. 1.

Referring to FIGS. 1 and 2 a humidifier 20 constructed in accordance with this invention includes two major elements. One major element comprises a water tank 21 with an open top bounded by a peripheral edge 22 for storing water. The other major element is an assembly 23 that rests on the top of the water tank 21 and with a portion extending into the interior of the water tank 21. The assembly 23 includes a warm mist distributor 24 with a mixing chamber proximate the open top of the water tank 21. A vaporization module 25 depends from the warm mist distributor 24 for immersion in water in the water tank 21.

The warm mist distributor 24 includes a plurality of input ports 26 disposed about a lower periphery thereof and adapted to be positioned just above the opening 22. An exhaust port 27 at the top of the warm mist distributor 24 allows warm mist to pass when the vaporization module 25 is energized. The warm mist distributor also contains a medicant well 28 on one side of the exhaust port 27. As will become apparent later, fasteners connect the warm mist distributor 24 and the vaporization module 25 in a subassembly.

Figure 3:
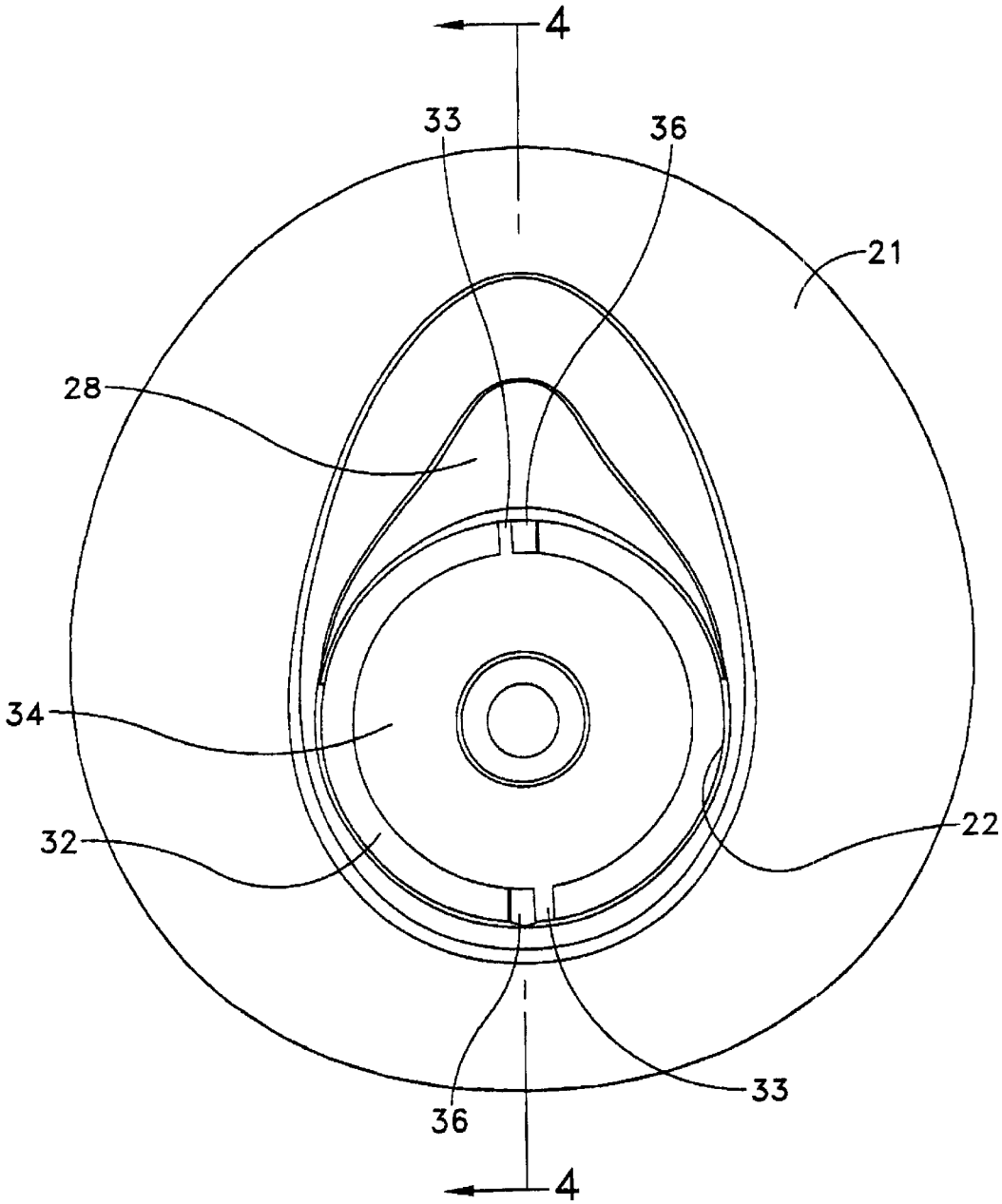
FIG. 3 is a top view of a water tank shown in FIG. 1.

Referring now to FIGS. 2 and 3, the vaporization module 25 includes a housing 30 with two diametrically disposed splines with one such spline being shown in FIG. 2. The spline 31 includes a lower vertical section 31A and an upper skewed section 31B. The other spline has the same construction and configuration. The water tank 21 includes an inwardly extending radial shoulder 32 that includes two diametrically disposed radial slots 33.

During installation, the assembly 23 is positioned above an opening 34 formed by the edge 22 and oriented so the vertical spline sections, like the section 31A, align with the radial slots 33. As the warm mist distributor 24 and attached vaporization module 25 are lowered into the opening 34, the vertical spline sections, like the section 31A, pass through the radial slots 33. In this position the warm mist distributor 24 will be rotated slightly from its final operating position.

As the assembly 23 continues to be lowered, the edges of the shoulders 32 engage the skewed sections like the section 31B. Continued downward motion rotates the assembly 23 relative to the water tank 21, in this embodiment in a clockwise direction viewed from the top of FIG. 2. When the assembly 23 reaches its lowest position, additional clockwise motion of the assembly 23 causes an end portion on each spline, such as the end portion 35 of the spline 31, to pass under an integrally molded detent 36 in the shoulder 32 adjacent a corresponding slot to lock the assembly in an operating orientation. This prevents inadvertent removal of the assembly from the water tank 21.

Water Tank 21

Figure 4:
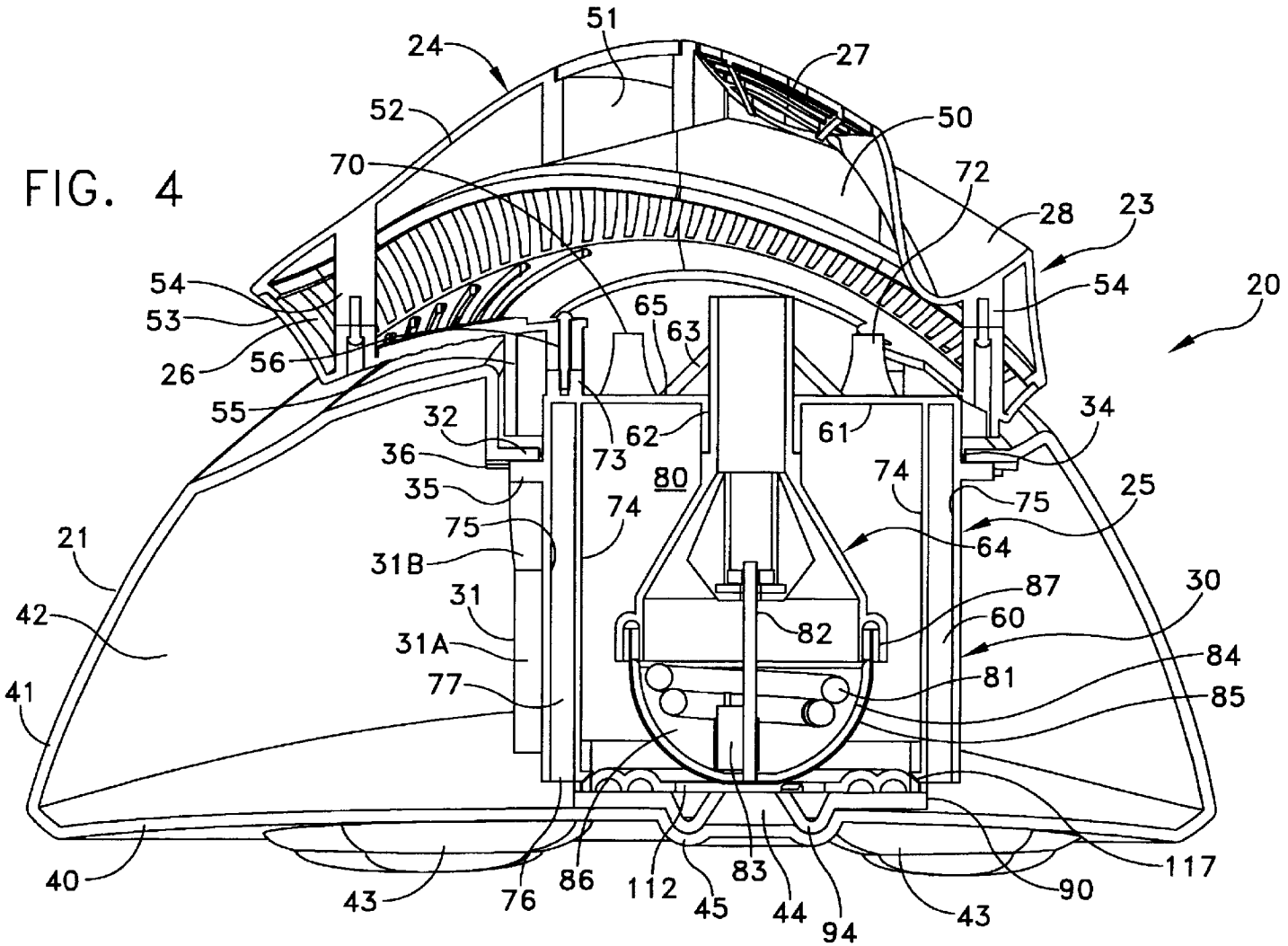
FIG. 4 is a section of an assembled humidifier taken generally along lines 4—4 in FIG. 3.

Now referring particularly to FIG. 4, the water tank 21 includes a base 40 and an integral, solid, free form, generally concave upper housing wall 41 that forms a reservoir 42. The upper housing wall 41 terminates with the rounded edge 22 that forms the top opening 34 with the shoulder 32. In this embodiment, the top opening 34 is offset slightly from the center of the water tank 21. The water tank 21 also includes feet 43 that space the base 40 from any supporting surface. The base 40 also forms a well 44 that aligns with the top opening 34 and that is bounded by a circumferential seat 45. As will be apparent, when the assembly 23 is removed, water can be readily added into the water storage chamber 42 through the top opening 34.

Warm Mist Distributor 24

Still referring to FIG. 4, the warm mist distributor 24 defines a mixing chamber 50 that receives air through the input ports 26 and dispenses a warm mist mixture through the exhaust port 27. The warm mist distributor 24 additionally includes a compartment 51 for receiving an electrical cord and for making connections to other conductors that connect to the vaporization module 25 as will be described hereinafter. The placement of such connections and routing of such cords is well within the capability of a person of ordinary skill in the art.

In this specific embodiment the warm mist distributor 24 comprises an upper member 52 that contains the exhaust port 27 and the medicant well 28. A lower member 53 carries the inlet port 26. A plurality of post-and-screw or similar structures, such as structure 54, are distributed internally generally about the periphery of the warm mist distributor 24 for enabling the connection of the upper member 52 and the lower member 53. A cylindrical shroud 55 depends from the lower member 53 and carries plural posts. One post 56 appears in FIG. 4. These posts support the vaporization module 25 as will become evident later.

Steam from the vaporization module 25 enters the chamber with sufficient velocity to produce a pressure differential that forces exterior air through the input ports 26 to mix in the chamber 50 with the moving steam. During the mixing process, the air cools the steam so the mixture becomes a warm mist. The momentum of the steam carries this mixture up through the exhaust port 27.

Vaporization Module 35

Referring specifically to FIG. 4, the housing 30 forming the exterior of the vaporization module 25 has a top horizontal closure 61 formed with a central sleeve 62 that supports a cylindrical support 63 for a heating element 64. A push nut 65 clamps the cylindrical base in the top horizontal closure. A plurality of spaced nozzles 66, 67, 68, 70, 71 and 72 extend from the top horizontal closure 61.

Figure 5:
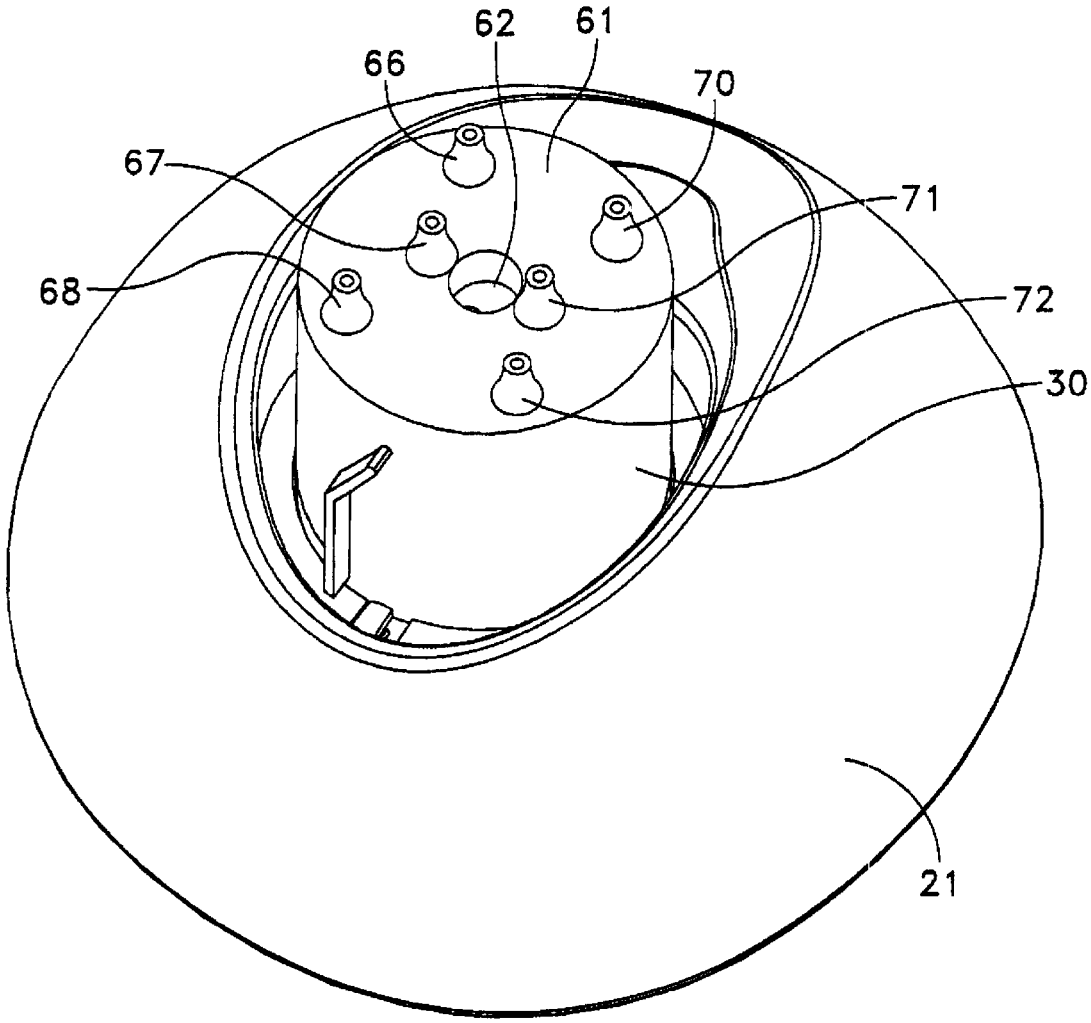
FIG. 5 is a perspective view of a boiling chamber shown in FIG. 4.

U.S. Pat. No. 5,343,551 describes the theory and rationale for using a single nozzle with a vaporizer. In accordance with one aspect of this invention, each of the plurality of nozzles 66 through 68 and 70 through 72 has an area corresponding to a portion of the calculated area for a single nozzle. In this particular embodiment with six identical-nozzles, the area of each nozzle is ⅙ the area calculated according to U.S. Pat. No. 5,343,551. As shown in FIGS. 4 and 5, each of the nozzles delivers the steam along a vertical axis. That is, each nozzle produces a straight flow of steam that is parallel with respect to the steam flow from the other nozzles. As nozzle length is a function of area, the nozzle heights in accordance with this invention are considerably shorter than required for a single nozzle. This leads to the reduction of the overall height and size of the vaporizer. In addition, this allows the nozzles to be positioned to produce a steam column of increased cross-section that rises from the vaporization module 25. Consequently there is a better distribution of water vapor in the air exiting the exhaust port 27 as a warm mist.

Nozzles can be distributed arbitrarily. In accordance with a further embodiment of this invention, however, the nozzles 68 and 72 are located proximate the medicant well 28 shown in FIGS. 1 and 4. This allows heat to transfer from the steam through the well 28 into the medicant and thereby to promote better medicant evaporation into the warm mist exiting the exhaust port 27.

As another feature of a humidifier 20 constructed in accordance with this invention, the vaporization module 25 additionally includes circumferentially spaced posts, such as a post 73 at the top horizontal closure 61. These posts match with corresponding posts in the lower member 53 to allow a permanent connection of the warm mist distributor 24 and the vaporization module 25.

In accordance with another aspect of this invention, the housing 60 for the vaporization module 25 has axially extending, radially spaced inner and outer walls 74 and 75, that form an insulating air annulus. The top horizontal closure 61 closes the annulus at the top. The annulus is open at the bottom at 76. As the annulus is closed at the top, when the assembly 23 is lowered into the water tank 21, water will not rise appreciably into the annulus. Consequently the air space 77 acts as an insulator between a boiling chamber 80 within the vaporization module 25 and the water in the reservoir 42. This significantly reduces any heat transfer from the boiling chamber 80 to water in the reservoir 42. Consequently the reservoir of water in the water tank 21 remains cool.

The heating element 64 is a variation on the heating element shown in the above-identified U.S. patent application Ser. No. 09/571,231. The base 63 carries conductors from the chamber 51 into the boiling chamber 80 that includes a heating element 81 in a coil form that is suspended from the base 63 by a support 82. A thermostat 83 controls the temperature of the heating element 81. The elements are interconnected by wiring that is not shown in FIG. 4 for purposes of clarity, but will be apparent from the disclosure in the above-identified U.S. patent application Ser. No. 09/571,231.

The heating element 64 additionally has an aluminum semi-spherical layer 84 and a stainless steel layer 85 that forms a cavity 86 which receives the heater 81. These are carried on the support 63 with peripheral sealing structure 87. Consequently the heating element 81 and other components are sealed from any water in the tank 21 or in the boiling chamber 80.

The housing 30 has an open bottom across the bottom of the inner cylindrical wall 74. An end closure structure 90 closes the bottom and performs three specific functions. First, it allows the boiling chamber 80 to fill quickly when the assembly is lowered into the water tank 21. Thereafter the end closure 90 meters water into the boiling chamber 80 to control the vaporization and to prevent any back flow from the boiling chamber 80 into the water storage chamber 42. Finally, the end closure 90 allows rapid draining of water in the boiling chamber 80 into the water reservoir in the storage tank 21 if the assembly 23 is lifted from water tank 21. Any water in the boiling chamber 80 then disperses through the colder water in the reservoir 42 to minimize any risk of boiling water scalding an individual handling the elements.

Figure 6A:
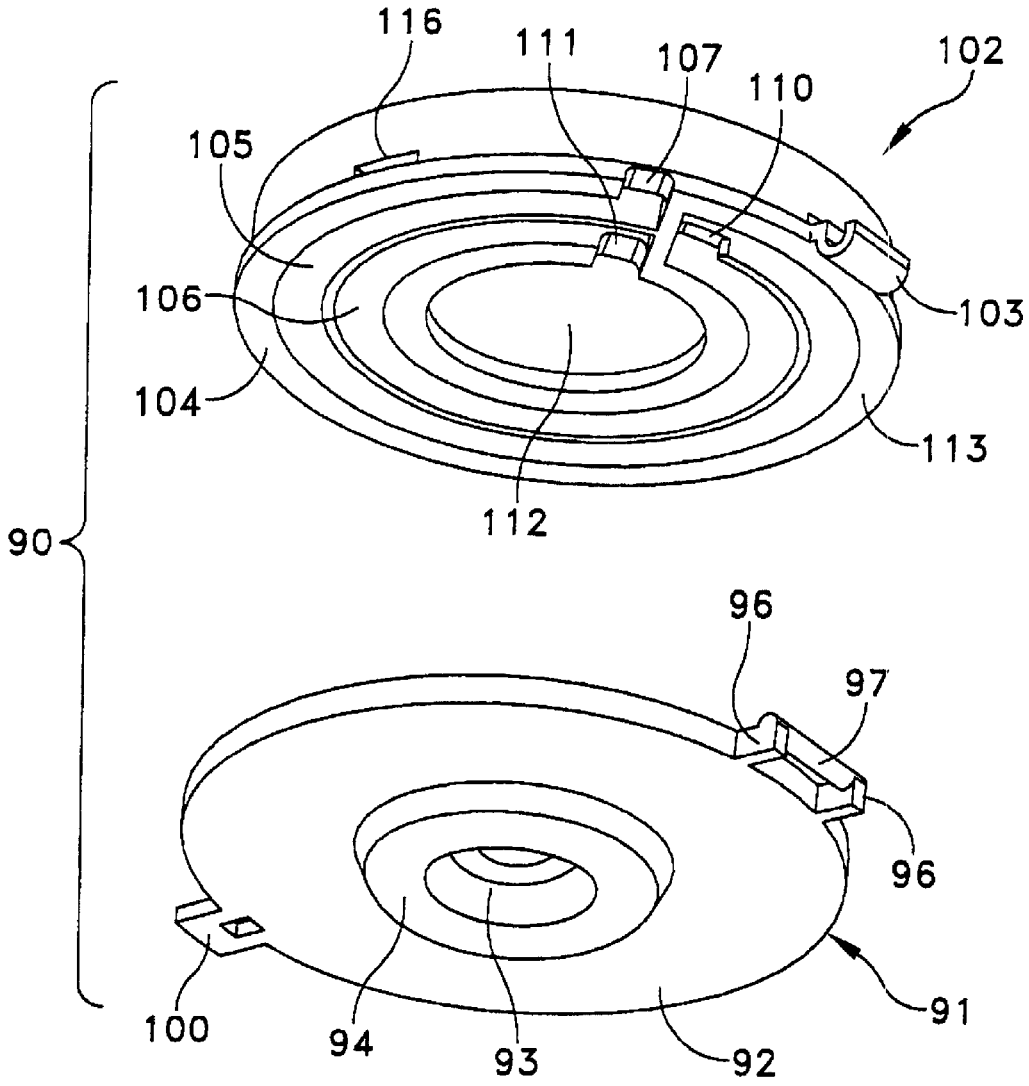
FIGS. 6A and 6B are exploded views of an end closure shown in FIG. 4
Figure 6B:
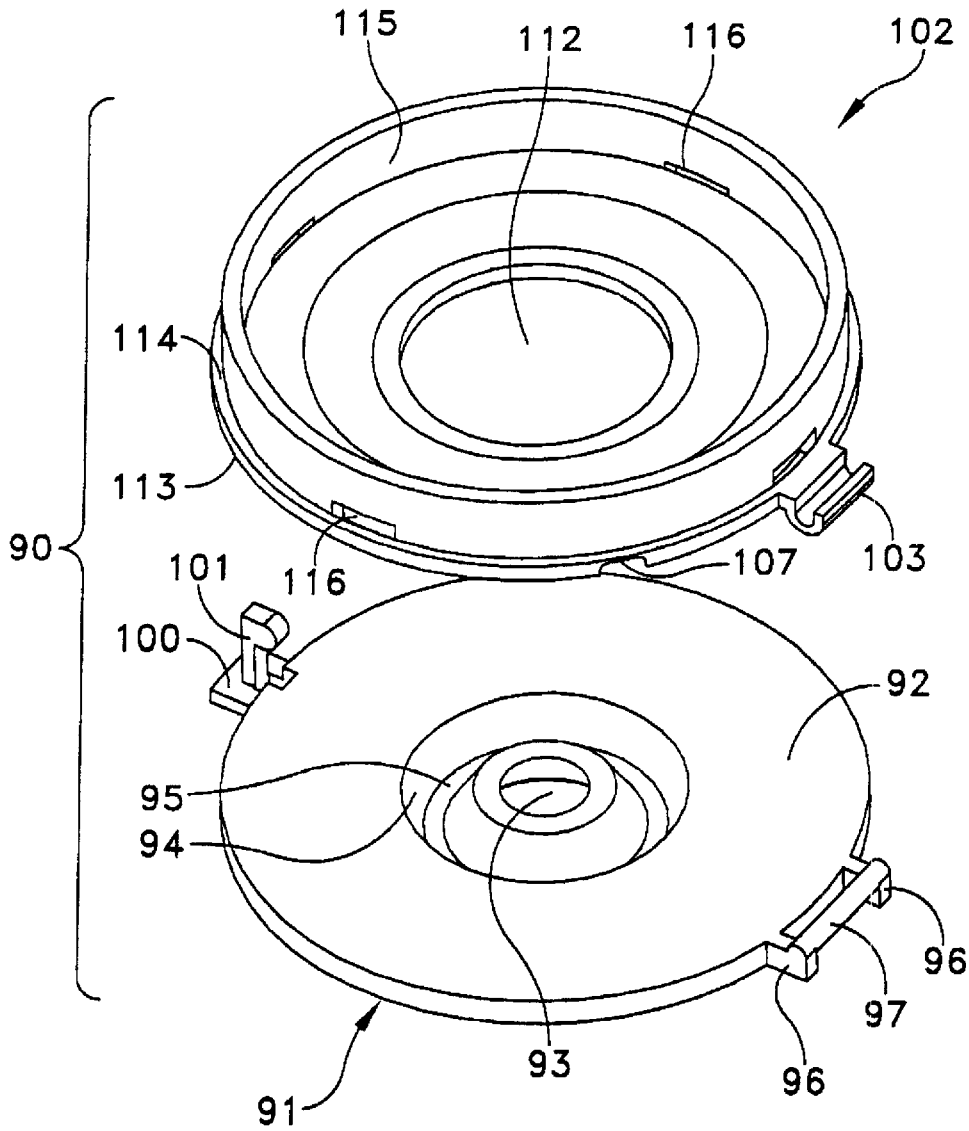

Referring to FIGS. 4, 6A and 6B, the end closure 90 includes a lower element 91 that has a generally planar annular body portion 92 about a central opening 93. An axially extending circumferential extension 94 from the bottom forms a shoulder and, as best seen from FIG. 6B, forms an internal, circumferential groove 95 facing upward. The element 91 has a first radial extension formed by spaced, parallel arms 96 for carrying a hinge pin 97. The diametrically opposed edge of the element 91 has a radially extending arm 100 with a latch 101.

A second annular element 102 is also an annular structure that includes a hinge body 103 that engages the hinge pin 97 so the upper element 102 and lower element 91 can be hinged together.

A bottom surface of the upper element 102, as best shown in FIG. 6A, has two concentric grooves 105 and 106 formed therein formed in the annular element. A radial passage 107 extends from the exterior of the upper element 102 to the outer groove 105. A second radial passage 110 extends between the ends of the concentric grooves 105 and 106 remote from the radial passage 107. Another radial passage 111 at the position of the radial passage 107 extends from the inner groove 106 to a central opening 112.

The upper element 102 additionally includes a radial extension 113 with a shoulder 114 from an axially extending collar 115. The shoulder 114 includes a plurality of equiangularly spaced slots 116. During assembly, the upper element 102 slides into the bottom of the boiling chamber 80 with the collar 115 sliding against the inner wall 74. The inner wall 74 has discrete latch extensions 117 that ride over the collar 114 and then snap into the respective ones of the slots 116. As a result the upper element 102 closes the bottom of the boiling chamber 80 except for the opening 112.

The bottom element 91 connects to the upper element by positioning the hinge body 103 on the hinge pin 97. Then the bottom element 91 pivots until the latch 101 engages the shoulder 114. When the lower element 91 and upper element 112 are hinged and latched together, the end closure 90 forms a labyrinth passage so water enters the passage 107 to travel through the length of the outer concentric passage 105, the radial passage 110 and the inner concentric passage 106 to exit through the radial passage 111 into the central opening 112. This long labyrinth passage performs two functions. It meters any water passing through the labyrinth such that the flow rate tends to be relatively independent of the input pressure. Second, it minimizes the impact of any pressure build up at the radial passage 111 that otherwise could cause a back flow of hot water into the water storage chamber 42.

As the assembly 23 is lowered into a full water tank 21, water immediately passes through the openings 93 and 112 in the end closure 90 to fill the boiling chamber 80 to the level of the water in the water tank 21. However, as the assembly 23 is rotated to a final position, the circumferential extension 94 and forms a seal with the circumferential seat 45. This prevents any further water from transferring through the openings 93 and 112.

After the heater 81 is energized, steam accumulates in the boiling chamber 80 so the internal pressure rises and drives the steam through the nozzles 66 through 68 and 70 through 72 where it accelerates and thereafter mixes with air in the mixing chamber 50. More specifically, the humidifier 20 operates with a difference between the water levels in the reservoir 42 and in the boiling chamber 80. This water level difference is created by the pressure built up in the boiling chamber 80. If water could transfer without metering, then water inside the boiling chamber 80 would be depleted as some of it converts to steam causing the water level in the boiling chamber 80 to drop below the level which is needed to drive the steam. Water from the water tank 21 could then flow into the boiling module 80 and temporarily stop the boiling process. This would reduce the pressure inside the boiling chamber 80 and allow even more cool water to enter into the boiling chamber 80. Eventually, however, the boiling process would resume, but with excess water in the boiling chamber 80. As the pressure increases, boiling water could be driven back into the reservoir 42 thereby warming the water.

The labyrinth structure of this invention prevents this event sequence. First, the end closure 90 is a part of the boiling chamber 80. Water passing into the boiling chamber 80 will be heated as it passes through the labyrinth. This minimizes the temperature variations in the boiling chamber 80 that could otherwise occur. If an over pressure condition in the boiling chamber 80 were to occur, the labyrinth would impede any transfer of heated water back into the reservoir 42.

Another feature of this invention can be appreciated by considering the removal of the assembly 23 during normal use, as when it is necessary to refill the reservoir 42. As soon as the assembly 23 is rotated to align the splines 31 with the slots 33 as shown in FIG. 2, the seal produced by the circumferential extension 94 and the seat 45 is broken. Any heated water in the boiling chamber 80 immediately drains into the remaining water in the reservoir 42. So the boiling chamber 80 is empty by the time the assembly 23 is removed from the water tank 21. Given the relatively small volume of water in the boiling chamber 80 in comparison to the volume of water in the water tank 21, the temperature of the water in the boiling chamber 80 will rapidly diminish to achieve an equilibrium temperature that is significantly lower than boiling point even if a minimum water level exists in the reservoir 42.

The two-piece end closure 90 facilitates maintenance. From time to time materials in the reservoir 42 may pass into the labyrinth and clog it. Such obstructions are easily cleared by removing the assembly 23 to expose the end closure 90. Then the latch 101 can be moved so the bottom member 91 can be pivoted about the hinge pin 97 and expose the grooves 105 and 106 and radial passages 107, 110 and 111 for cleaning. This occurs with minimal risk of anyone accessing the boiling chamber 80.

In summary, a humidifier constructed in accordance with the foregoing features realizes all of the objectives of this invention. It delivers a warm mist with evenly distributed water vapor having a temperature well below that of steam. If the vaporizer is being used with a medicant, the process of distributing the medicant in the warm mist is improved by warming the medicant. The boiling chamber is small in comparison to the water tank and minimizes heat transfer, so the water in the reservoir remains cool. The combination of the boiling chamber, nozzles and labyrinth provides a substantially constant vaporization rate notwithstanding the level of the water in the water tank. In addition, the construction of the labyrinth facilitates initial filling and draining of the boiling chamber whenever the assembly with the boiling chamber is inserted into and removed from the water tank, respectively. It also facilitates cleaning without providing access to any electrical connections or the heating element.

The foregoing description and drawings depict a specific embodiment of a humidifier that incorporates this invention. Many variations can be made. The boiling chamber is shown as a cylindrical structure with a specific heating element. Alternate chamber shapes and heating elements could be substituted. The water tank has a specific shape and construction; water tanks with other shapes and constructions can be used to implement this invention. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A humidifier comprising:

A. an open top water tank for storing water,

B. a warm mist distributor supported on said water tank with a mixing chamber proximate the open top, C. a vaporization module in said water tank depending from said distributor and including:

1. a boiling chamber,
2. a heater in said boiling chamber, and
3. a plurality of nozzles extending from said boiling chamber for directing steam along parallel vertical paths into said mixing chamber to mix with air and produce a warm mist.

2. A humidifier as recited in claim 1 wherein said vaporization module includes a passage for metering water from said water tank into said boiling chamber.

3. A humidifier as recited in claim 1 wherein said vaporization element additionally comprises an end closure element with a labyrinth passage between said water tank and said boiling chamber.

4. A humidifier as recited in claim 3 wherein said end closure element comprises first and second members with one of said members having a groove corresponding to the labyrinth passage formed therein.

5. A humidifier as recited in claim 4 wherein each of said first and second members has a central opening therethrough and one of said members includes means for sealing said end closure against said water tank thereby to prevent any passage of water through said central opening.

6. A humidifier as recited in claim 4 wherein said first and second members are hinged together.

7. A humidifier as recited in claim 3 wherein said vaporization module has spaced walls extending from said end closure thereby to produce an air space about said boiling chamber.

8. A humidifier as recited in claim 7 wherein said heater has a semi-spherical heating surface.

9. A humidifier as recited in claim 7 additionally comprising means for fastening said warm mist distributor and said vaporization module in an assembly for insertion through the opening in said water tank whereby said vaporization module is immersed in the water in said water tank and said warm mist distributor is positioned exteriorly of said water tank.

10. A humidifier as recited in claim 9 additionally comprising a locking mechanism having portions disposed on said water tank and said assembly that locks said assembly in said water tank.

11. A humidifier as recited in claim 9 additionally comprising splines on one of said water tank and said vaporization module and a shoulder with as groove on the other of said water tank and said vaporization module whereby said splines pass through the grooves during insertion and removal of said assembly from said water tank and said splines are positioned against said shoulder when said assembly is in an operating position in said water tank.

12. A humidifier as recited in claim 7 wherein each of said nozzles has a diameter that accelerates steam passing therethrough and said warm mist distributor includes a first passage for admitting air to said mixing chamber in response to the passage of steam from said nozzles and a second passage for directing the warm mist to the exterior of said distributor.

13. A humidifier as recited in claim 12 wherein said distributor includes an external medicant well and wherein one of said nozzles directs steam toward the position of said medicant well.

14. A humidifier as recited in claim 1 wherein said vaporization element has an end closure element and said chamber has spaced walls extending from said end closure element thereby to produce an air space between said boiling chamber and said water tank.

15. A humidifier as recited in claim 14 wherein said heater has a semi-spherical heating surface.

16. A humidifier as recited in claim 14 additionally comprising means for fastening said warm mist distributor and said vaporization module in an assembly for insertion through the opening in said water tank whereby said vaporization module is immersed in the water in said water tank and said warm mist distributor is positioned exteriorly of said water tank.

17. A humidifier as recited in claim 16 additionally comprising a locking mechanism having portions disposed on said water tank and said assembly that locks said assembly in said water tank.

18. A humidifier as recited in claim 16 additionally comprising splines on one of said water tank and said vaporization module and a shoulder with a groove on the other of said water tank and said vaporization module whereby said splines pass through the grooves during insertion and removal of said assembly from said water tank and said splines are positioned against said shoulder when said assembly is in an operating position in said water tank.

19. A humidifier as recited in claim 14 wherein each of said nozzles has a diameter that accelerates steam passing therethrough and said warm mist distributor includes a first passage for admitting air to said mixing chamber in response to the passage of steam from said nozzles and a second passage for directing the warm mist to the exterior of said distributor.

20. A humidifier as recited in claim 19 wherein said distributor includes an external medicant well and wherein one of said nozzles directs steam toward the position of said medicant well.

21. A humidifier as recited in claim 14 wherein said vaporization module includes an end closure element at one end thereof and said metering passage comprises a labyrinth in said end closure element between said water tank and said boiling chamber.

22. A humidifier as recited in claim 21 wherein said end closure element comprises first and second members with one of said members having a groove corresponding to the labyrinth formed therein.

23. A humidifier as recited in claim 22 wherein each of said first and second members has a central opening therethrough and one of said members includes means for sealing said end closure against said water tank thereby to prevent any passage of water through said central opening.

24. A humidifier as recited in claim 22 wherein said first and second members are hinged.

25. A humidifier as recited in claim 1 wherein each of said nozzles has a diameter that accelerates steam passing therethrough and said warm mist distributor includes a first passage for admitting air to said mixing chamber in response to the passage of steam from said nozzles and a second passage for directing the warm mist to the exterior of said distributor.

26. A humidifier as recited in claim 25 wherein said distributor includes an external medicant well and wherein one of said nozzles directs steam toward the position of said medicant well.

27. A humidifier as recited in claim 25 additionally comprising means for fastening said warm mist distributor and said vaporization module in an assembly for insertion through the opening in said water tank whereby said vaporization module is immersed in the water in said water tank and said warm mist distributor is positioned exteriorly of said water tank.

28. A humidifier as recited in claim 27 additionally comprising a locking mechanism having portions disposed on said water tank and said assembly that locks said assembly in said water tank.

29. A humidifier as recited in claim 27 additionally comprising splines on one of said water tank and said vaporization module and a shoulder with a groove on the other of said water tank and said vaporization module whereby said splines pass through the grooves during insertion and removal of said assembly from said water tank and said splines are positioned against said shoulder when said assembly is in an operating position in said water tank.

30. A humidifier as recited in claim 25 wherein said heater has a semi-spherical heating surface.

31. A humidifier as recited in claim 25 wherein said vaporization module includes an end closure element at one end thereof and said metering passage comprises a labyrinth in said end closure element between said water tank and said boiling chamber.

32. A humidifier as recited in claim 31 wherein said end closure element comprises first and second members with one of said members having a groove corresponding to the labyrinth formed therein.

33. A humidifier as recited in claim 32 wherein each of said first and second members has a central opening therethrough and one of said members includes means for sealing said end closure against said water tank thereby to prevent any passage of water through said central opening.

34. A humidifier as recited in claim 32 wherein said first and second members are hinged together.

* * * * *